US010791820B2

(12) United States Patent
Langenwalter et al.

(10) Patent No.: US 10,791,820 B2
(45) Date of Patent: Oct. 6, 2020

(54) ADJUSTABLE CARRYING DEVICE

(71) Applicant: Fiskars Brands, Inc., Madison, WI (US)

(72) Inventors: Keith Langenwalter, Ridgefield, WA (US); Jamie Olson, Portland, OR (US); Cheryl Sharp, Portland, OR (US); Nate Zwetzig, Portland, OR (US); Benjamin J. Nyssen, Tigard, OR (US)

(73) Assignee: Fiskars Brands, Inc., Middleton, WI (US)

( * ) Notice: Subject to any disclaimer, the term of this patent is extended or adjusted under 35 U.S.C. 154(b) by 0 days.

(21) Appl. No.: 15/177,174

(22) Filed: Jun. 8, 2016

(65) Prior Publication Data

US 2016/0360870 A1 Dec. 15, 2016

Related U.S. Application Data

(60) Provisional application No. 62/175,133, filed on Jun. 12, 2015.

(51) Int. Cl.

| | |
|---|---|
| ***A45F 5/00*** | (2006.01) |
| ***A45F 5/02*** | (2006.01) |
| ***B26B 29/00*** | (2006.01) |
| ***B26B 29/02*** | (2006.01) |

(52) U.S. Cl.

CPC ..... *A45F 5/00* (2013.01); *A45F 5/021* (2013.01); *B26B 29/00* (2013.01); *B26B 29/025* (2013.01); *A45F 2200/0566* (2013.01); *A45F 2200/0575* (2013.01); *A45F 2200/0591* (2013.01)

(58) Field of Classification Search

CPC ..... A45F 5/021; A45F 2200/0508; A45F 2200/0516; A45F 2200/0525; A45F 2200/0566; A45F 2200/0575; A45F 2200/0591; A45F 2200/0533; Y10S 224/904; Y10S 224/93; A45C 2011/001; A45C 2013/1015

USPC ..... 224/236–241, 199, 660, 682, 901.2, 224/901.4, 901.6, 901.8

See application file for complete search history.

(56) References Cited

U.S. PATENT DOCUMENTS

| | | | | |
|---|---|---|---|---|
| 2,096,376 A | | 10/1937 | Lauppe | |
| 4,937,920 A | * | 7/1990 | Tsai | A44C 5/00 24/3.2 |
| 5,653,367 A | * | 8/1997 | Abramson | A45F 3/14 224/197 |

(Continued)

FOREIGN PATENT DOCUMENTS

| | | |
|---|---|---|
| CN | 1328901 A | 1/2002 |
| CN | 1361043 A | 7/2002 |

*Primary Examiner* — Scott T McNurlen

(74) *Attorney, Agent, or Firm* — Foley & Lardner LLP

(57) ABSTRACT

An adjustable sheath for carrying an article includes a main body having a front surface, a rear surface opposite the front surface, and a peripheral edge, a receptacle configured to receive an article, wherein the receptacle is coupled to the front surface and the receptacle includes an outer surface, and a strap configured to retain the article within the receptacle, the strap including a first end portion removably coupled to the rear surface of the main body and a second end portion removably coupled to the outer surface of the receptacle. The top strap passes over the peripheral edge of the main body when coupled to the rear surface main body and the outer surface of the receptacle.

11 Claims, 8 Drawing Sheets

(56) References Cited

U.S. PATENT DOCUMENTS

| | | | | |
|---|---|---|---|---|
| 5,941,434 | A * | 8/1999 | Green | A45F 5/02 224/195 |
| 6,029,273 | A * | 2/2000 | McCrane | A41D 13/065 2/16 |
| 6,182,878 | B1 * | 2/2001 | Racca | A45C 15/00 224/236 |
| 6,357,646 | B1 * | 3/2002 | Gur | A45F 5/02 224/237 |
| 6,412,674 | B1 * | 7/2002 | Lipke | A45C 7/00 224/235 |
| 6,612,432 | B2 * | 9/2003 | Motson | A45F 5/00 206/305 |
| 7,770,770 | B2 | 8/2010 | Murdoch et al. | |
| 8,308,033 | B2 | 11/2012 | Case et al. | |
| 2010/0288804 | A1 | 11/2010 | Youssefi-Shams et al. | |
| 2013/0221045 | A1 * | 8/2013 | McStay | A45F 5/021 224/183 |

* cited by examiner

ADJUSTABLE CARRYING DEVICE

CROSS-REFERENCE TO RELATED PATENT APPLICATIONS

This application claims the benefit of U.S. application Ser. No. 62/175,133, filed Jun. 12, 2015, which is incorporated herein by reference in its entirety.

BACKGROUND

The present invention relates generally to the field of carrying devices, such as sheaths.

Carrying devices, such as sheaths, may be used to carry a variety of articles or tools, such as multi-tools, large knives, small knives, flashlights, etc. Because such devices can range widely in shapes and sizes, a user must generally use different carrying devices specially sized for each of the devices or place the articles in a carrying device that is not sized for the article, in which case the article may not be securely held within the carrying device or may not be able to fit into the carrying device.

An adjustable carrying device may be adjusted in size to accommodate articles of various sizes. Current adjustable carrying devices may not be able to adjust to accommodate articles that vary in both girth and length. Other current adjustable carrying devices may be cumbersome to adjust, including straps that must be fed through slots and other openings in the adjustable carrying devices when rearranging the straps. Still other current adjustable carrying devices may include straps that are disposed at least partially within a receptacle in which the article is placed, creating "catch points" that may inhibit the insertion or removal of the article.

SUMMARY

One embodiment of the invention relates to an adjustable sheath for carrying an article including a main body having a front surface, a rear surface opposite the front surface, and a peripheral edge, a receptacle configured to receive an article, wherein the receptacle is coupled to the front surface and the receptacle includes an outer surface, and a strap configured to retain the article within the receptacle, the strap including a first end portion removably coupled to the rear surface of the main body and a second end portion removably coupled to the outer surface of the receptacle. The top strap passes over the peripheral edge of the main body when coupled to the rear surface main body and the outer surface of the receptacle.

Another embodiment of the invention relates to an adjustable carrying device for carrying an article, comprising a main body, a receptacle, and a top strap configured to retain the article in the receptacle. The main body includes a front surface, a rear surface opposite the front surface, and a top edge. The receptacle is coupled to the front surface. The a top strap includes a first end portion removably coupled to the rear surface and a second end portion removably coupled to an outer surface of the receptacle. When coupled to the main body and the receptacle, the top strap passes over the top edge of the main body.

Another embodiment of the invention relates to an adjustable carrying device for carrying an article. The adjustable carrying device includes a back panel, a front panel, two side panels connecting the back panel to the front panel. The back panel includes a first hook and loop fastener. The adjustable carrying device further includes a strap including a second hook and loop fastener configured to engage the back panel, and a third panel including a third hook and loop fastener configured to engage the back panel and the strap.

Another embodiment of the invention relates to an adjustable carrying device for carrying an article. The adjustable carrying device includes a main body with a front surface, a rear surface opposite the front surface, and a peripheral edge. The adjustable carrying device further includes a receptacle coupled to the front surface and a strap configured to retain the article within the receptacle. The strap includes a first end portion removably coupled to the rear surface and a second end portion removably coupled to an outer surface of the receptacle. When coupled to the main body and the receptacle, the strap passes over the peripheral edge of the main body.

BRIEF DESCRIPTION OF THE DRAWINGS

The invention will become more fully understood from the following detailed description, taken in conjunction with the accompanying drawings, wherein like reference numerals refer to like elements.

DETAILED DESCRIPTION

Figure 1:
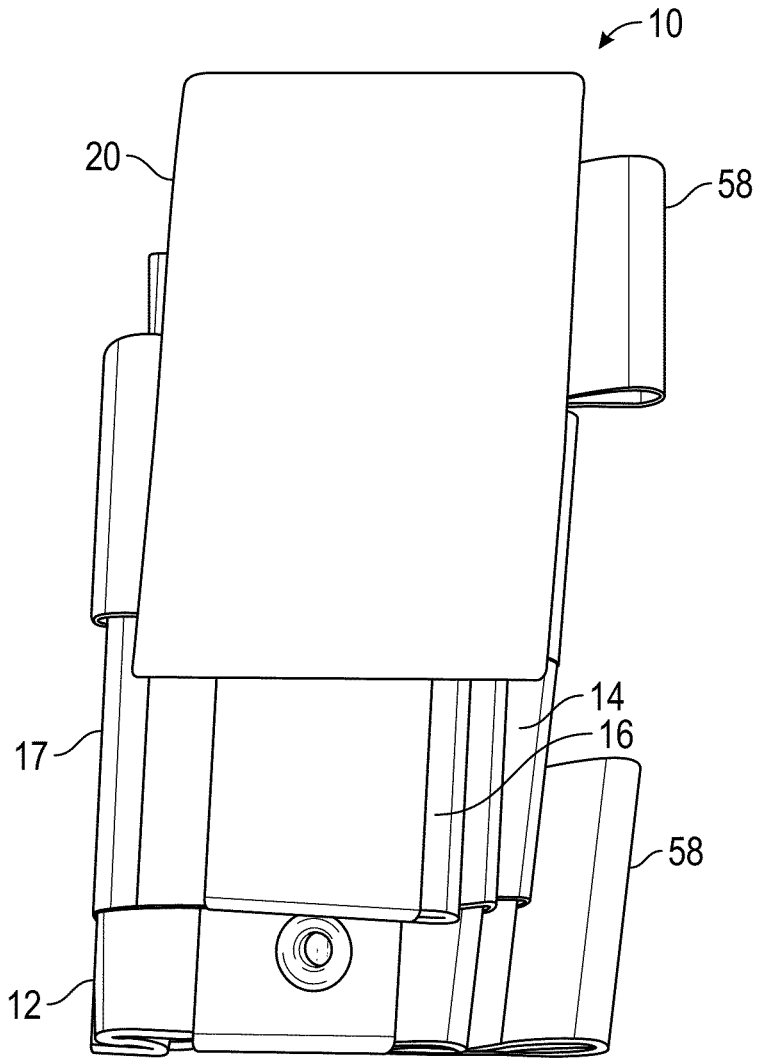
FIG. 1 is a front perspective view of an adjustable carrying device in a closed configuration, according to an exemplary embodiment.

Before turning to the figures, which illustrate the exemplary embodiments in detail, it should be understood that the application is not limited to the details or methodology set forth in the description or illustrated in the figures. It should also be understood that the terminology is for the purpose of description only and should not be regarded as limiting.

Referring in general to FIGS. 1-8, an adjustable carrying device (e.g., sheath) is configured to accommodate various articles of different length and girth, such as a multi-tool, large knife, small knife, flashlight, etc. The adjustable carrying device includes a main body and one or more receptacles with an adjustable width and depth and one or more top straps configured to secure an article in the receptacle. The position and length of the top strap are adjustable to secure articles having a variety of heights. The top strap is coupled to the main body in such a way that it does not intrude into the interior of the receptacle such that an article can be inserted into and removed from the receptacle without catching on the strap. The arrangement of the top strap allows for a clean, reliable, and quiet system whereby a user may easily adjust the carrying device to his or her particular needs. Once adjusted, the carrying device will remain functional until the user decides to change the configuration, at which point he or she is able to do so easily.

Referring to FIGS. 1-6, an adjustable carrying device 10 is shown according to an exemplary embodiment. The adjustable carrying device 10 includes a main body 12 (e.g., back panel) and one or more receptacles, shown as a first or rear pouch 14 and a second or front pouch 16. The pouches 14 and 16 are located on the front 18 of the main body 12. According to one exemplary embodiment, the pouches 14 and 16 are arranged such that the front pouch 16 is disposed in front of the rear pouch 14 (e.g., further away from the main body 12). In other embodiments, as detailed below, the adjustable carrying device 10 may include a number of receptacles in a stacked arrangement, a side-by-side arrangement, a front-to-back arrangement, or any combination thereof. The receptacles are generally defined by a rear panel, a front panel, and a pair of side panels. The receptacles include a top opening through which an article may be inserted in the receptacle. The bottom of the receptacle is at least partially closed to limit insertion of the article into the receptacle. In other embodiments, the bottom opening may be closed by coupling the bottom edges of the front panel and the rear panel, or the side panels. In embodiments of the adjustable carrying device 10 including multiple receptacles, a panel may partially define multiple receptacles. For example, the front panel of the rear pouch 14 may serve as the rear panel of the front pouch 16.

The receptacles may be configured to have a variable internal volume to accommodate differently sized articles. For example, the side panels may include a horizontally oriented elastic band 15. The elastic bands 15 allow the side panels of a receptacle to expand outward and allow the front panel of a receptacle to move relative to the rear panel. The receptacles (e.g., the rear pouch 14 and/or the front pouch 16) may therefore be configured to receive articles of varied girths. In other embodiments, the adjustable carrying device 10 may include a horizontal strap that extends around the receptacles and may be tightened or loosened to vary the internal volume of the receptacles. The horizontal strap may be coupled to a hook and loop fastener, such as a hook and loop fastener provided on the main body 12, as described in more detail below. The variable interior volume of the rear pouch 14 and the front pouch 16 allows for the adjustable carrying device 10 to accommodate a wide variety of articles securely, from a single article with a relatively small diameter to two articles with relatively large diameters.

A top strap 20 is provided to retain articles within the rear pouch 14 and the front pouch 16. The top strap 20 is disposed above the top opening of the rear pouch 14 and the front pouch 16. The top strap 20 is removably attached at a first end portion 22 to the front pouch 16 and is removably attached to the main body 12 at a second end portion 24. The top strap 20 extends between the first end portion 22 and the second end portion 24, the rear pouch 14 and the front pouch 16 so that when both end portions 22 and 24 are attached, the top strap 20 extends above a top edge 26 of the main body 12 to hold articles in place within the two pouches 14 and 16. The position of the first end portion 22 relative to the front pouch 16 and the position of the second end portion 24 relative to the main body 12 may be vertically adjusted to accommodate articles of various heights that are disposed within the rear pouch 14 and the front pouch 16. In some embodiments, the top strap 20 includes a buckle, ratchet, or other adjustment mechanism so that the effective length of the top strap 20 is variable. In the illustrated embodiment, the strap 20 and the peripheral edge 26 are shown as being the top strap 20 and the top edge 26 of the adjustable carrying device 10 when oriented in is normal operating position. In other embodiments, the strap 20 and the peripheral edge 26 may be oriented in different positions (e.g., left side, right side bottom) when the adjustable carrying device 10 is in its normal operating position.

Figure 2:
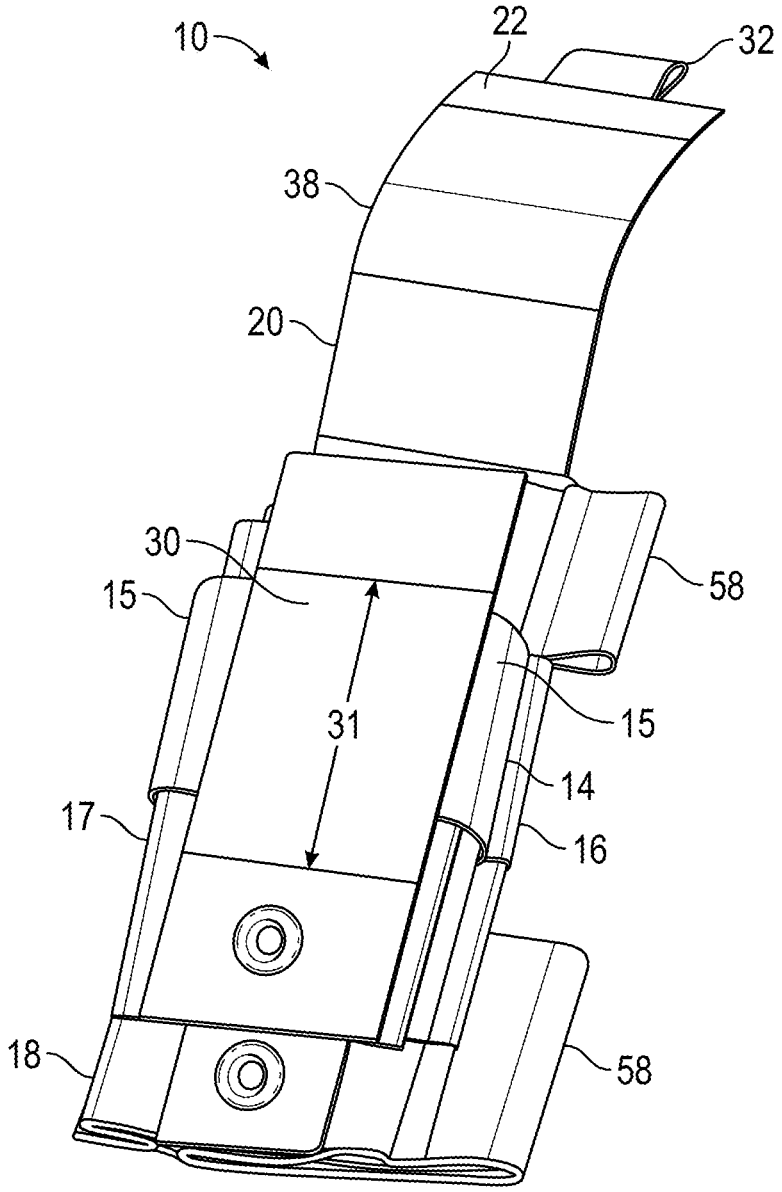
FIG. 2 is a front perspective view of the adjustable carrying device of FIG. 1 in an open configuration.
Figure 3:
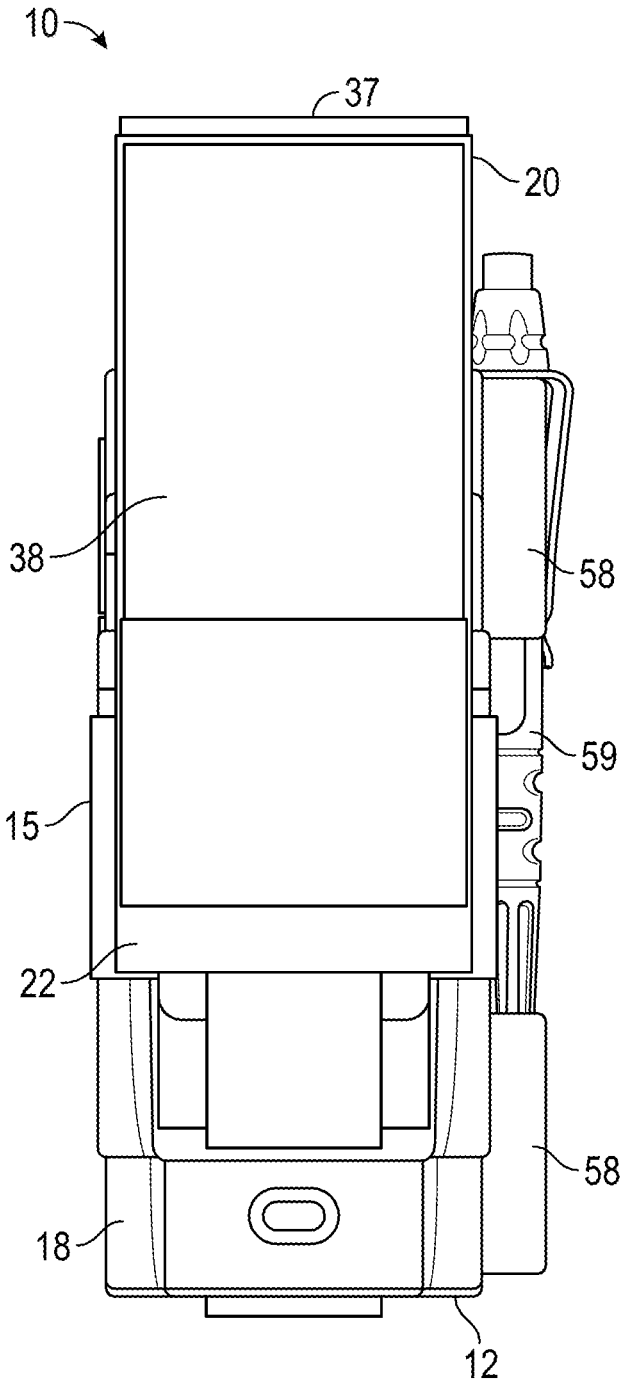
FIG. 3 is a front view of the adjustable carrying device of FIG. 1 in a closed configuration.

Referring to FIG. 2, the first end portion 22 of the top strap 20 is coupled to the front 17 of the front pouch 16. The first end portion 22 is removably coupled to the front pouch 16 with a fastener (e.g., a reclosable hook and loop fastener). A first fastener panel 30 is disposed on the front 17 of the front pouch 16 and a second fastener panel 32 is disposed at the first end portion 22 of the top strap 20. In some embodiments, the fastener panel 30 of the front pouch 16 is a hook panel and the fastener panel 32 of the top strap 20 is a loop panel. In other embodiments, the top strap 20 has the hook panel and the front pouch 16 has the loop panel. The hook panel may, in one embodiment, comprise unidirectional hooks such that the first end portion 22 of the top strap 20 may be detached from the front pouch 16 with minimal noise. In other embodiments, the first end portion 22 of the top strap 20 may be removably coupled to the front pouch 16 with any suitable reclosable coupling mechanism that provides multiple coupling locations arranged vertically along the front pouch 16, including, but not limited, to snaps, buttons, or a Dual Lock• fastener.

As shown in FIG. 2, the fastener panel 30 of the front pouch 16 extends for a vertical distance 31 to provide multiple coupling locations along the vertical distance 31 for the fastener panel 32 of the top strap 20. This enables a user to attach the first end portion 22 of the top strap 20 to the front pouch 16 at the appropriate location to secure a particular article within the pouches 14 and 16.

While the top strap 20 is shown as being coupled to the front pouch 16, in other embodiments, the first end portion 22 of the top strap 20 may be coupled to any suitable forward-facing surface of the adjustable carrying device 10. For example, in other embodiments, the first end portion 22 of the top strap 20 may be coupled to the front surface 18 of the main body 12.

Figure 5B:
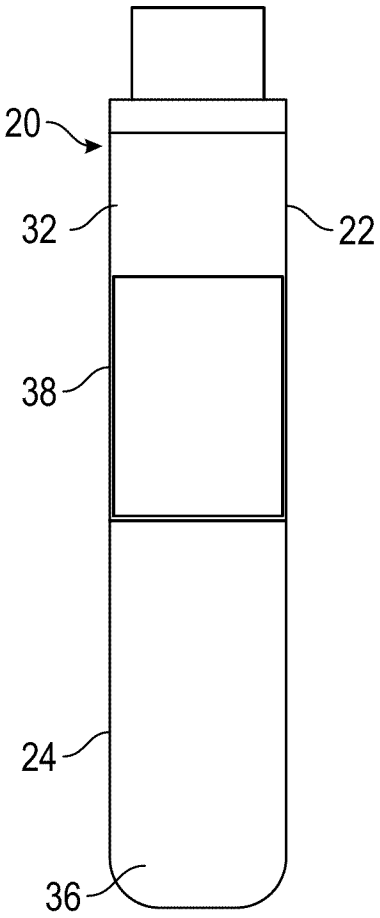
FIG. 5B is a rear view of the top strap of the adjustable carrying device of FIG. 1.
Figure 5A:
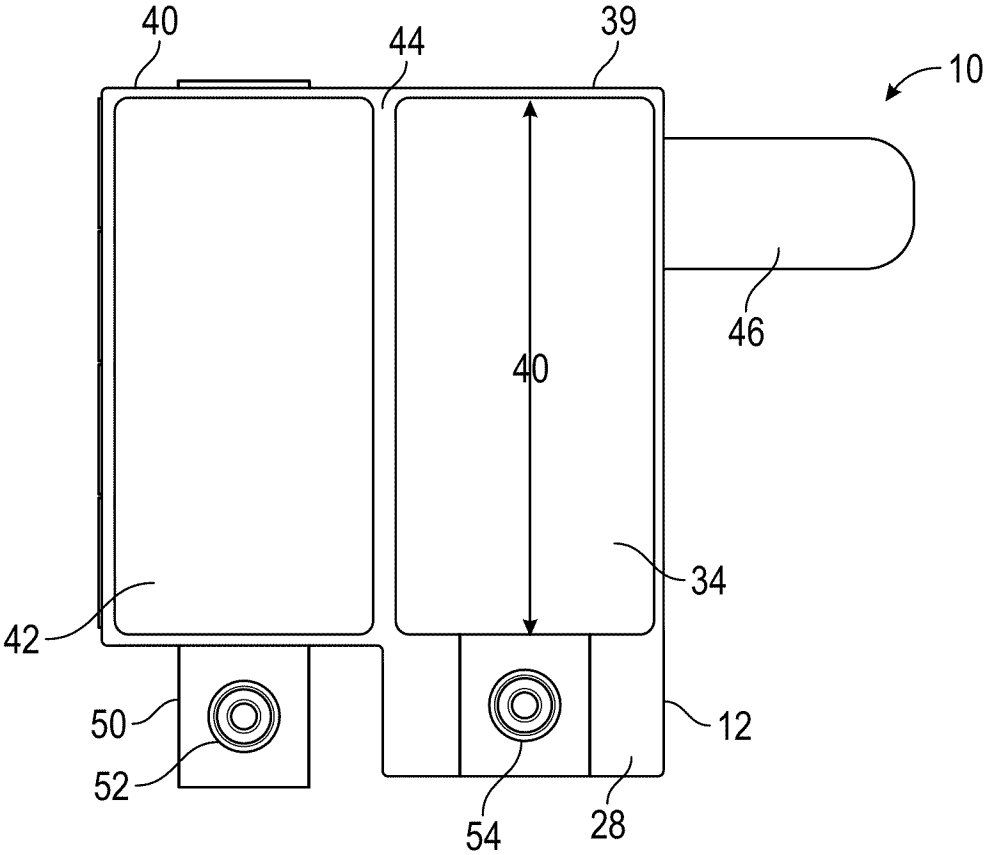
FIG. 5A is a rear view of the main body of the adjustable carrying device of FIG. 1.

Referring now to FIGS. 5A and 5B, the main body 12 of adjustable carrying device 10 is shown with the top strap 20 detached in FIG. 5A and the top strap 20 is illustrated in FIG. 5B.

As shown in FIG. 5, the main body 12 includes two body panels, a first or right side panel 39 and a second or left side panel 40. In one exemplary embodiment, the main body 12 is formed from a single fabric panel divided by a hinge 44 between the panel 39 and the panel 40. In other embodiments, the panel 39 and the panel 40 may separately formed and attached to one another to form the main body 12, such as sewing the two panels together. In another embodiment, the panel 40 may be provided as a body separate from the panel 39 and may be removably coupled to the panel 39 with a hook and loop fastener or another fastening mechanism disposed on the rear surface 28 of the main body 12 (e.g., snaps, etc.). In still other embodiments, the panel 40 may be absent and the panel 39 may be directly coupled to another body. For example, the panel 39 may be coupled to a vest, backpack, or other piece of equipment of clothing having a suitable fastening mechanism (e.g., a hook panel to which the loop panel 34 may be coupled).

According to an exemplary embodiment, the second end portion 24 of the top strap 20 is coupled to the rear surface 28 of the main body 12 with a fastener (e.g., a reclosable hook and loop fastener). A first fastener panel 34 is disposed on the rear surface 28 of the first panel 39 of the main body 12 and a second fastener panel 36 is disposed at the second end portion 24 of the top strap 20. In some embodiments, the fastener panel 34 of the rear surface 28 is a loop panel and the fastener panel 36 of the top strap 20 is a hook panel. In other embodiments, the top strap 20 has the loop panel and the rear surface 28 of the main body 12 has the hook panel. In other embodiments, second end portion 24 of the top strap 20 may be coupled to the main body 12 with any suitable reclosable coupling mechanism that provides multiple coupling locations arranged vertically along the main body 12, including, but not limited, to snaps, buttons, or a Dual Lock™ fastener. The fastener panel 32 and the fastener panel 36 are located on the same side of the top strap 20. A third fastener panel 37 (FIG. 3) is located on the opposite side of the top strap 20. In some embodiments, the fastener panel 37 is positioned at the second end portion 24 of the top strap 20 and may extend to the middle of the strap 20. In other embodiments, the fastener panel 37 covers an entire side of the top strap 20.

As shown in FIG. 5A, the fastener panel 34 on the rear surface 28 of the first panel 39 of the main body 12 extends for a vertical distance 41 to provide multiple coupling locations along the vertical distance 41 for the fastener panel 36 of the top strap 20. This enables a user to attach the second end portion 24 of the top strap 20 to the rear surface 28 of the main body 12 at the appropriate location to secure a particular article within the pouches 14 and 16. A fastener panel 42 is located on the rear surface 28 of the second panel 40 of the main body 12 so that the panel 40 may be removably coupled to the panel 39, such as with a hook and loop fastener. In one exemplary embodiment, the fastener panel 42 is a hook panel that is configured to engage the loop panel 34. In other embodiments, the fastener panel 42 is the loop panel and the fastener panel 34 is the hook panel.

When both the panel 40 and the second end portion 24 of the top strap 20 are coupled to the fastener panel 34, the second end portion 24 of the top strap 20 is sandwiched between the panel 40 and the panel 39, preventing the fastener panel 36 of the top strap 20 from disengaging or peeling off of the fastener panel 34 without first separating the panels 39 and 40. The fastener panels 36 and 37 of the top strap 20 may be provided by a single-thickness material with the hook panel 36 on one side and the loop panel 37 on the opposite side. The second end portion 24 of the top strap 20 may therefore be coupled to both the panel 39 (e.g., through an engagement with the fastener panel 34) and to the panel 40 (e.g., through an engagement with the fastener panel 42) to further secure the top strap 20 while minimizing the overall thickness of the adjustable carrying device 10.

In some embodiments, the top strap 20 may be reversible. That is, the top strap 20 may be configured such that either the first end portion 22 or the second end portion 24 may be coupled to the rear surface 28 of the main body 12 and either the first end portion 22 or the second end portion 24 may be coupled to the front pouch 16 or another front-facing surface of the adjustable carrying device 10. To achieve this reversibility, the first end portion 22 and the second end portion 24 may include similar connection means. For example, both the first end portion 22 and the second end portion 24 may include a single-thickness material with hooks on one side and loops on the opposite side such that either end portion can engage a loop panel or a hook panel. In other embodiments, the first end portion 22 and the second end portion 24 may both include multiple connection means. For example, the end portions may include both a hook or loop panel and a snap.

As shown in FIG. 5B, in one exemplary embodiment, the top strap 20 has a consistent width along its length. In other embodiments, the width of the top strap 20 may be variable. For example, the first end portion 22 or the second end portion 24 may be wider or narrower than the rest of the top strap 20. In other exemplary embodiments, the top strap 20 may taper from one end to the other. For example, the first end portion 22 may be wider than the second end portion 24 or narrower than the second end portion 24 and the top strap 20 may gradually taper or incrementally change width between the first end portion 22 and the second end portion 24.

According to one exemplary embodiment, the top strap 20 includes a resilient portion 38. The resilient portion 38 may be formed by elastic, shock cord, or other resilient material and allows the top strap 20 to stretch as needed to accommodate longer items disposed in the receptacles and contract as needed to accommodate shorter items disposed in the receptacles. The top strap 20 may include a single resilient portion 38 extending between the first end portion 22 and the second end portion 24, a single resilient portion 38 extending only a portion of the length of the top strap 20 (e.g., coupled on one or both ends to a length of webbing or other material), or multiple resilient portions. In some embodiments, the resilient portion 38 of the top strap 20 is omitted. In some embodiments, the length of the top strap 20 may be further adjusted by buckle, ratchet, ladder lock or other adjustment system. In other embodiments, the length of the top strap 20 is not adjustable.

In some embodiment, the top strap 20 may include a material to increase the friction between the top strap 20 and an article disposed in the receptacle and retained by the strap 20. For example, the top strap may include band of silicone on the lower surface.

Figure 6A:
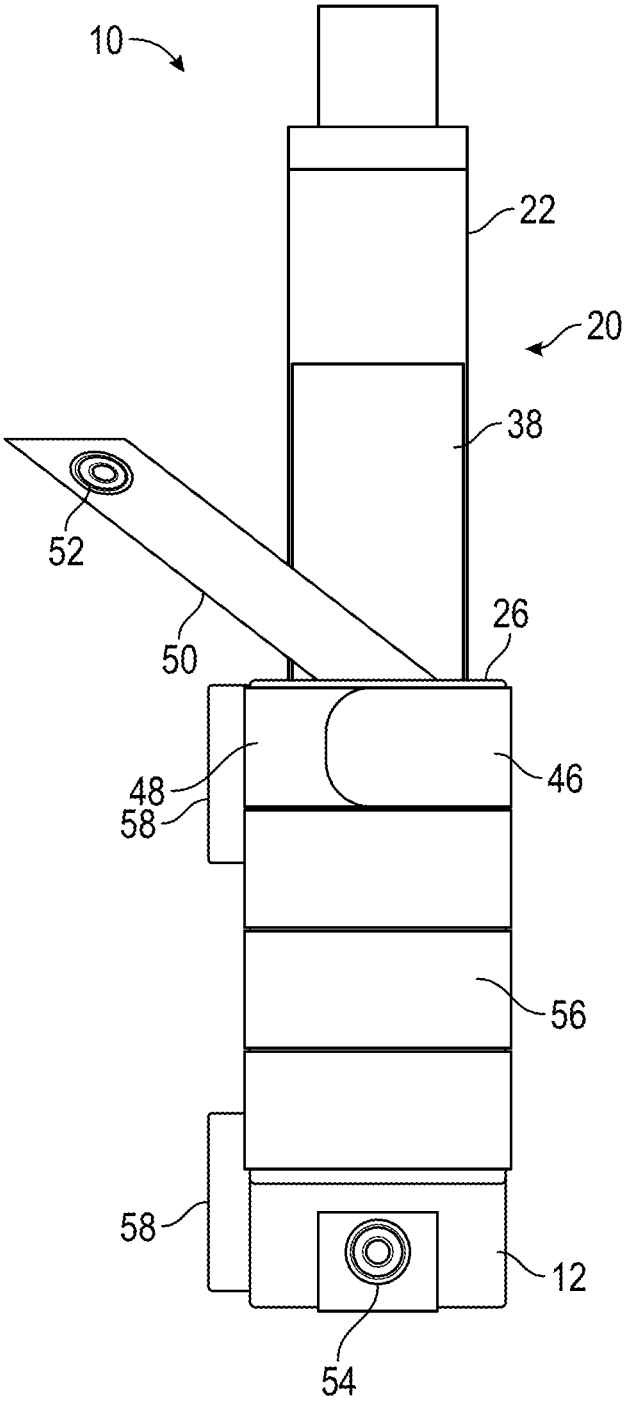
FIG. 6A is a rear view of the adjustable carrying device of FIG. 1 with a belt strap in an open configuration.
Figure 6B:
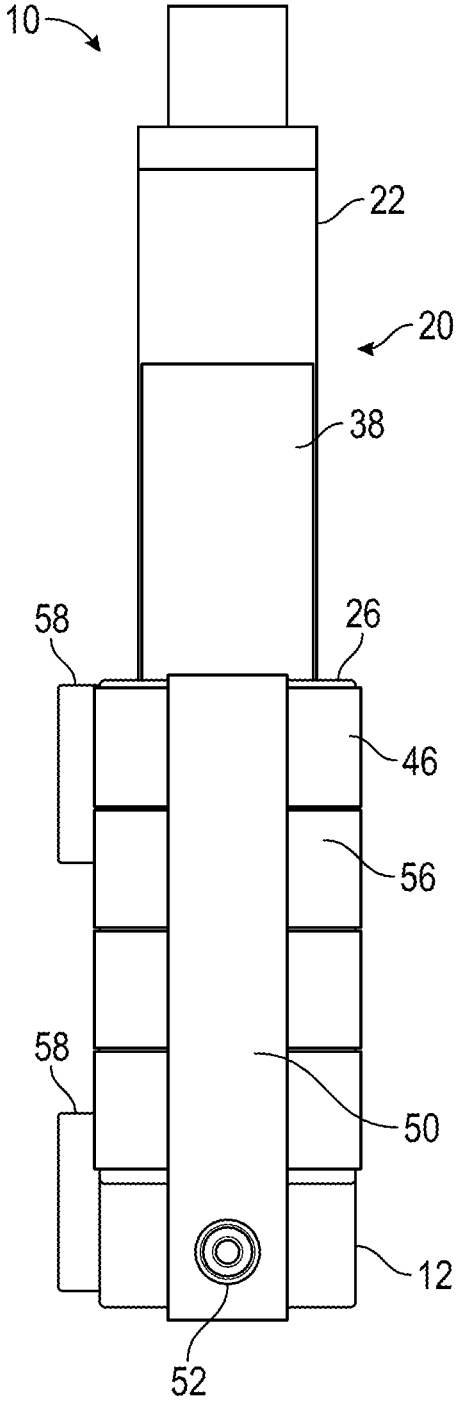
FIG. 6B is a rear view of the adjustable carrying device of FIG. 1 with the belt strap in a closed configuration.

Referring to FIGS. 5A, 6A, and 6B, the panels 39 and 40 may be further secured to one another with a security or lock strap or tab 46. The lock tab 46 is coupled to the panel 39 of the main body 12 and is provided on a side of the main body 12 opposite of the fabric hinge 44. The lock tab 46 is configured to be wrapped or folded around the panel 40 and engage the opposite side of the panel 40 to prevent the fastener panel 42 of the rear panel 40 from disengaging or peeling off of the fastener panel 34 of the panel 39. According to an exemplary embodiment, the lock tab 46 includes a fastener panel that is a hook panel configured to be coupled to a fastener panel 48 that is a loop panel provided on the panel 40. In other embodiments, the lock tab 46 has the loop panel and the panel 40 has the hook panel. In still other embodiments, other reclosable fasteners (e.g., snaps) are used. In other embodiments, the adjustable carrying device 10 may include additional lock tabs. The additional lock tabs may be provided on the side opposite of the fabric hinge 44 or may be provided on an adjacent edge (e.g., the top or bottom edge).

A mounting structure, shown as a rear strap 50 is provided to allow the adjustable carrying device 10 to be mounted to a piece of clothing or equipment, such as a vest, belt, backpack, etc. The rear strap 50 is attached on one end to the main body 12. As illustrated, the rear strap is attached to the panel 40. The opposite end of the rear strap 50 includes a fastening mechanism, shown as a snap 52. To mount the adjustable carrying device 10, the distal end of the rear strap 50 is fed behind one or more structures, such as a belt or a length of webbing or strap (e.g., as a part of a pouch attachment ladder system (PALS)). The distal end of the rear strap 50 is then secured by coupling the snap 52 to a corresponding snap 54 on the main body 12. According to an exemplary embodiment, the snap 54 is provided on the panel 39. In other embodiments, the adjustable carrying device 10 may not include the rear strap 50 and may be otherwise mounted (e.g., using the fastener panel 34). The rear strap 50 may be adjustable to allow a user to adjust the elevation of the adjustable carrying device 10 relative to a belt or other attachment system.

The rear strap 50 and the top strap 20 operate independently of each other. The top strap 20 may be removed, and repositioned (e.g., to accommodate a new article in one of the receptacles) without interference from the rear strap 50. This allows a user to adapt the top strap 20 to secure items of various sizes in the receptacle without removing the adjustable carrying device 10 from the item of clothing or equipment to which it is mounted. Likewise, distal end of the rear strap 50 may be unattached without interference from the top strap 20. This allows the adjustable carrying device 10 to be moved between articles of clothing or equipment without removing articles from the receptacles. Additionally, the configuration of the top strap 20 and the rear strap 50 allows an optional horizontal strap (not shown) to be used independently to compress or expand the receptacles.

Referring to FIGS. 6A-6B, the adjustable carrying device 10 may include PALS webbing 56. According to an exemplary embodiment, the adjustable carrying device 10 includes PALS webbing 56 on the rear side of the rear panel 40. The PALS webbing 56 allows the adjustable carrying device 10 to be mounted to any compatible structure, such as a tactical vest, a rucksack, or modular lightweight load-carrying equipment ("MOLLE"). The relative positions of the PALS webbing 56 and the top strap 20 allows either to operate independently of the other.

In some embodiments, the top strap 20 may also include PALS webbing. For example, is the top strap 20 is mounted to the main body such that a portion of the second end portion 24 is exposed and the second end portion 24 is formed of a single thickness hook and loop material, PALS webbing may be mounted to the second end portion 24 with a hook and loop fastener. PALS webbing on the top strap may be used to mount the adjustable carrying device 10 in cooperation with the PALS webbing 56. The adjustable carrying device 10 may include additional features, such as loops 58 configured to hold a small diameter object, such as a pen or stylus 59.

In some embodiments, the adjustable carrying device 10 may be configured to carry an identification card. For example, the adjustable carrying device 10 may include a compartment for an identification card disposed below the receptacles, integrated with the front panel of a receptacle, or integrated with the top strap 20.

The two panels 39 and 40 of the main body 12 may be adapted to perform other functions. For example, the panels 39 and 40 may be configured to hold fishing hooks or other small, sharp objects by trapping the hooks between the fastener panels 34 and 42. In another embodiment, the panels 39 and 40 may be sized such that a compartment may be disposed between the two panels 39 and 40. The compartment may be utilized, for example, to receive a firearm.

Figure 4:
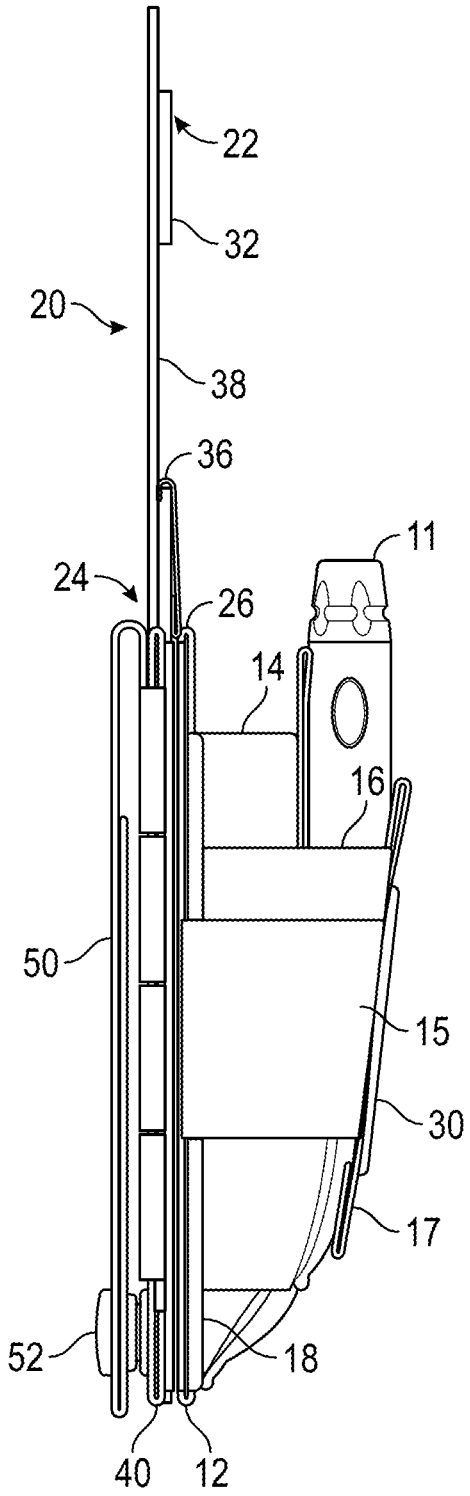
FIG. 4 is a side view of the adjustable carrying device of FIG. 1 in an open configuration.

In operation, an article, shown as flashlight 11 in FIG. 4, is inserted into front pouch 16. Another article pay be inserted into rear pouch 14. The top strap 20 is attached to the rear surface 28 of the main body 12 by engaging the fastener panel 36 with the fastener panel 34 of the panel 39 of the main body 12. The second end portion 24 and the fastener panel 36 of the top strap 20 can be positioned and attached as needed along the vertical distance or height 41 of the fastener panel 34 to provide a sufficient effective length of the top strap 20 to secure the flashlight 11 or other article within the pouch 16 when the first end portion 22 of the top strap 20 is attached to the pouch 16. For example, for relatively short articles, the second end portion 24 and the fastener panel 36 of the top strap 20 would be positioned near the bottom of the height 41 of the fastener panel 34 to provide a relatively short effective length of the top strap 20. For relatively long articles, the second end portion 24 and the fastener panel 36 of the top strap 20 would be positioned near the top of the height 41 of the fastener panel 34 to provide a relatively long effective length of the top strap 20. The effective length of the top strap 20 is the length of strap between the top edge 26 of the main body 12 and the fastener panel 32 of the first end portion 22 when the second end portion 24 of the top strap 20 is attached to the main body 12. The main panel 12 is folded along the hinge 44 to couple the panels 39 and 40 together by engaging the fastener panel 42 of the panel 40 with one or both of the faster panel 34 of the panel 39 and the fastener panel 37 of the top strap 20 to hold the top strap 20 and the panels 39 and 40 in place. The lock tab 46 is folded around the panel 40 and attached to the faster panel 48 to further hold the top strap 20 and the panels 39 and 40 in place. The top strap 20 is folded over the top edge 26 of the main body 12 to contact (engage, cover, etc.) the flashlight 11 or other article and the fastener panel 32 of the first end portion 22 of the top strap 20 is attached to the fastener panel 30 of the pouch 16 to hold or secure the flashlight 11 or other article in the pouch 16. The fastener panel 32 and the first end portion 22 are attached to different locations along the vertical distance or height 31 of the fastener panel 30 depending on the effective length of the top strap 20. For example, with a relatively long effective length, the fastener panel 32 and the first end portion 22 are attached near the bottom of the height 31, and with a relatively short effective length, the fastener panel 32 and the firs end portion 22 are attached near the top of the height 31. The strap 20 is arranged in a similar manner to hold an article in the pouch 14.

The top strap 20 is positioned such that it extends above the main body 12 and the top openings of the pouches 14 and 16. This positioning allows for the length and position of the top strap 20 to be adjusted while an object is in place in the pouches 14 or 16. The length of the top strap 20 may therefore be adjusted to the length needed with a single operation instead of approximating the correct position and/or length of the top strap, inserting an item into the receptacle, testing the top strap, and then adjusting the top strap based on the fit. Because the top strap 20 is coupled to the rear surface 28 of the main body 12 and the front 17 of the pouch 16, it does not intrude into the interior of either pouch 14 or 16 and does not provide any protruding elements on which an item may be caught as it is inserted into or withdrawn from either pouch.

Figure 7:
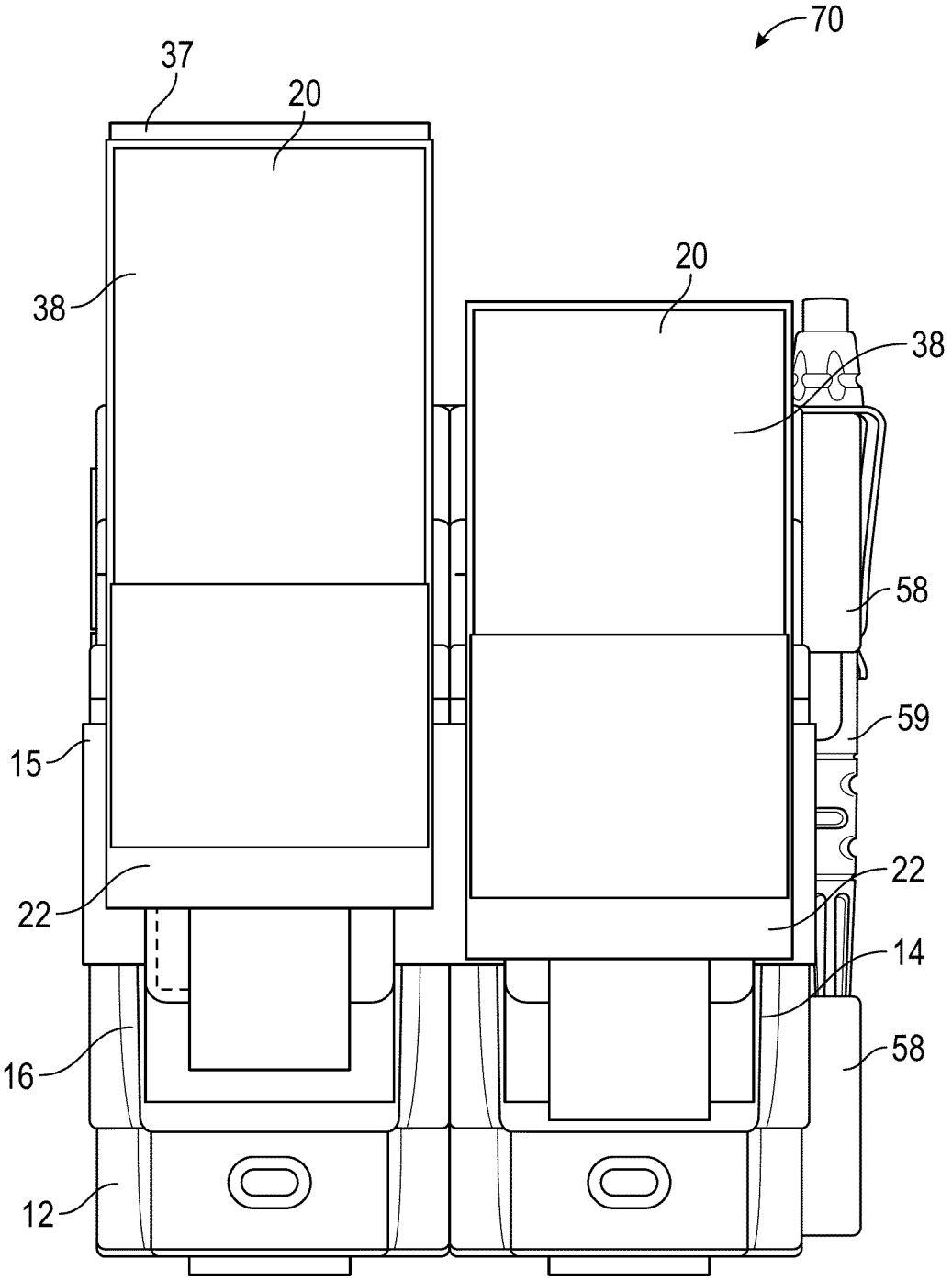
FIG. 7 is a front view of an adjustable carrying device, according to another exemplary embodiment.
Figure 8:
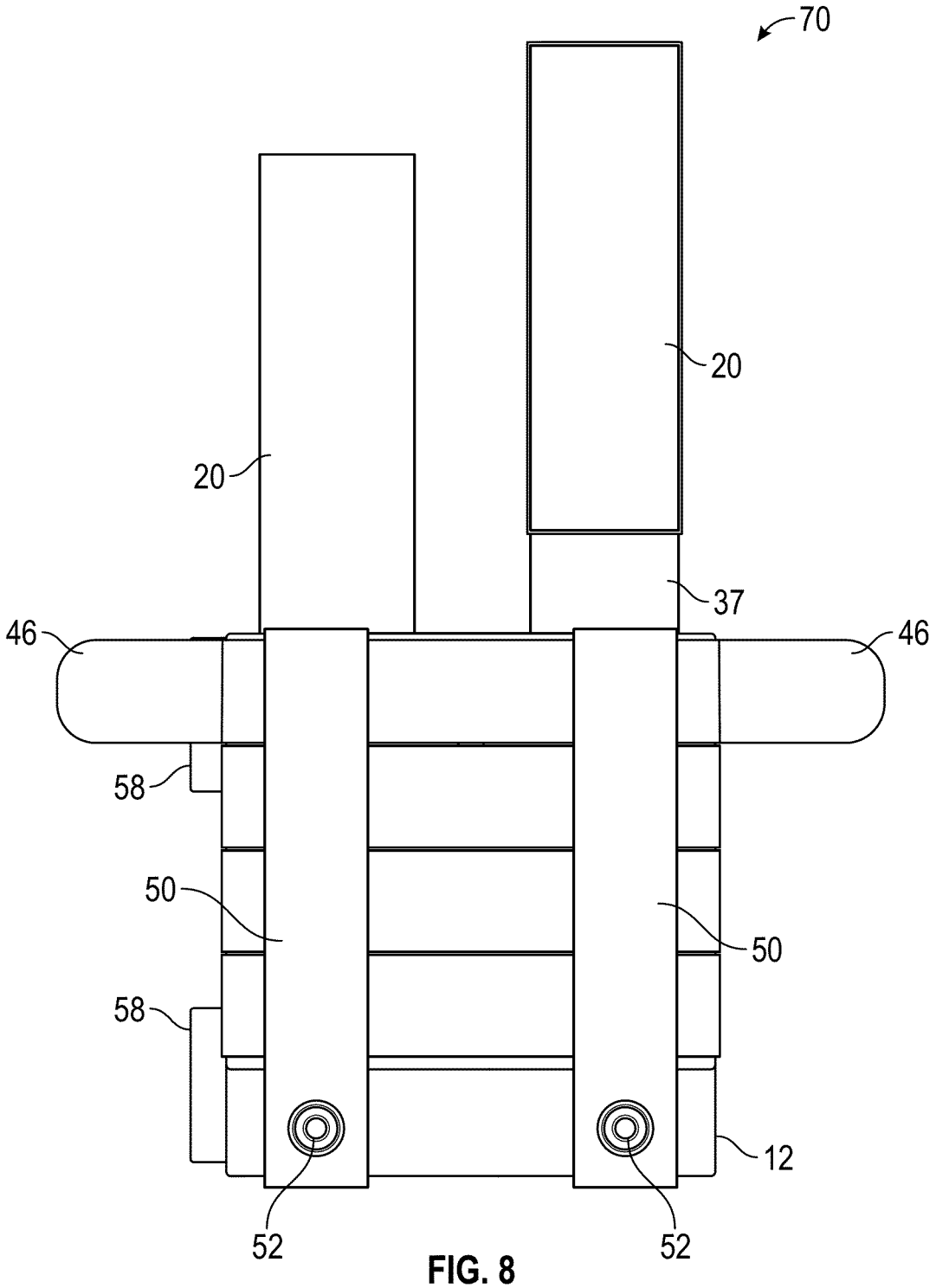
FIG. 8 is a rear view of the adjustable carrying device of FIG. 7.

Referring now to FIGS. 7-8, an adjustable carrying device 70 is shown according to another exemplary embodiment. The adjustable carrying device 70 is similar in configuration to the adjustable carrying device 10 but includes receptacles 14 and 16 positioned side-by-side, each coupled to a common main body 12 with a top strap 20 for each receptacle. Each of the top straps 20 may be independently adjusted. In some embodiments, the adjustable carrying device 70 may include several top straps, only some of which are adjustable. Other top straps may be mounted statically to the main body 12.

In some embodiments, the adjustable carrying devices 10 and 70 may include other adjustable straps that are configured similar to the top straps 20. For example, the adjustable carrying device 10 and 70 may include bottom straps passing over a bottom edge of the main body or otherwise oriented straps that pass over a peripheral edge of the main body.

While the adjustable carrying devices 10 and 70 are shown as being formed from soft goods, in other embodiments, the adjustable carrying devices 10 and 70 may be predominantly hard goods or may be a mixture of soft good and hard goods. For example, the main body 12 may be formed from a rigid polymer while the receptacles and straps are formed from fabrics and other soft goods.

While some components are described as being coupled together with specific removable connection means, such as hook and loop fasteners or snaps, in other embodiments, any suitable removable connection means may be used. For example, the lock tab may attach to the rear panel 40 with a snap connection instead of a hook and loop connection. Likewise, the distal end of the rear strap 50 may attach to the main body 12 with a hook and loop fastener instead of with a snap.

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

The construction and arrangement of the elements of the adjustable carrying device as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. Some like components have been described in the present disclosure using the same reference numerals in different figures. This should not be construed as an implication that these components are identical in all embodiments; various modifications may be made in various different embodiments. It should be noted that the elements and/or assemblies of the enclosure may be constructed from any of a wide variety of materials that provide sufficient strength or durability, in any of a wide variety of colors, textures, and combinations. Furthermore, other substitutions, modifications, changes, and omissions may be made in the design, operating conditions, and arrangements of the exemplary embodiments without departing from the scope of the invention as expressed in the appended claims.

What is claimed is:

1. An adjustable sheath for carrying an article, comprising:

a main body, comprising:

a front surface, a rear surface opposite the front surface, a peripheral edge; and a first body fastener panel extending for a height is attached to the rear surface;

a receptacle configured to receive an article, wherein the receptacle is coupled to the front surface and the receptacle includes an outer surface and a second body fastener panel extending for a height is attached to the outer surface;

a strap configured to retain the article within the receptacle, the strap comprising a first end portion having a first strap fastener panel being a hook and loop fastener panel configured to be removably and reusably coupled to the first body fastener panel at a plurality of locations along the height of the first body fastener panel to vary an effective length of the strap and a second end portion having a second strap fastener panel being a hook and loop fastener panel configured to be removably and reusably coupled to the second body fastener panel at a plurality of locations along the height of the second body fastener panel to vary an effective length of the strap;

a mounting strap having a first end and a second end, the first end attached to and extending away from the rear surface of the main body and the second end removably coupled to the main body to form a loop partially defined by the main body; and an elastic band positioned between the front surface of the main body and the outer surface of the receptacle to allow a front panel of the receptacle to move relative to a rear panel of the receptacle so that the receptacle is expandable to receive articles of varied girth;

wherein the strap passes over the peripheral edge of the main body when coupled to the first body fastener panel and the second body fastener panel, and wherein the mounting strap operates independently of the strap.

2. The adjustable sheath of claim 1, wherein the first body fastener panel is one of a hook panel and a loop panel and the first strap fastener panel is the other of the hook panel and the loop panel.

3. The adjustable sheath of claim 2, wherein the hook panel comprises unidirectional hooks.

4. The adjustable sheath of claim 1, wherein the main body includes a first body panel and a second body panel separated by a hinge;

wherein the first body panel includes the first body fastener panel and the second body panel includes a third body fastener panel attached to the rear surface;

wherein the main body is folded along the hinge and the third body fastener panel is removably attached to the first body fastener panel to hold the first end portion of the strap between the first body panel and the second body panel, wherein the first end of the mounting strap extends away from the second body panel; and wherein the second end of the mounting strap is removably coupled to the first body panel.

5. The adjustable sheath of claim 4, wherein the first body fastener panel is one of a hook panel and a loop panel and the third body fastener panel is the other of the hook panel and the loop panel.

6. The adjustable sheath of claim 4, further comprising:

a lock tab including a tab fastener panel, the lock tab coupled to the first body panel;

wherein the second body panel includes a fourth body fastener panel;

wherein the lock tab is folded over the second body panel and the tab fastener panel is removably attached to the fourth body fastener panel to hold in place the first end portion of the strap, the first body panel, and the second body panel.

7. The adjustable sheath of claim 6, wherein the tab fastener panel is one of a hook panel and a loop panel and the fourth body fastener panel is the other of the hook panel and the loop panel.

8. The adjustable sheath of claim 6, further comprising a second receptacle configured to receive a second article.

9. The adjustable sheath of claim 4, wherein the first strap fastener panel is attached to a first side of the strap and a third strap fastener panel is attached to a second side of the strap located opposite the first side so that when the main body is folded along the hinge, the first strap fastener panel is removably attached to the first body fastener panel and the third strap fastener panel is removably attached to the third body fastener panel.

10. The adjustable sheath of claim 1, further comprising a second receptacle configured to receive a second article.

11. The adjustable sheath of claim 10, wherein the second receptacle is positioned forward of the front surface of the main body.

* * * * *